US005337131A

United States Patent [19]

Sagiv et al.

[11] Patent Number: 5,337,131

[45] Date of Patent: Aug. 9, 1994

[54] CHARGING APPARATUS OPERATIVE TO CHARGE A SURFACE

[75] Inventors: Oded Sagiv, Cochav Yair; Yevgeny Korol, Petach Tikva, both of Israel

[73] Assignee: Indigo N.V., Veldhoven, Netherlands

[21] Appl. No.: 974,465

[22] Filed: Nov. 12, 1992

[51] Int. Cl.[5] ..... G03G 15/02

[52] U.S. Cl. ..... 355/221; 250/324

[58] Field of Search ..... 355/219, 221, 222, 225; 250/324–326; 361/229, 230

[56] References Cited

U.S. PATENT DOCUMENTS

| | | | |
|---|---|---|---|
| 3,578,970 | 5/1971 | Michaud | 355/221 X |
| 3,920,327 | 11/1975 | Kato | 355/308 |
| 4,746,796 | 5/1988 | Heigl | 250/324 |
| 5,008,538 | 4/1991 | DeCecca et al. | 250/324 |
| 5,023,748 | 6/1991 | Okamoto et al. | 361/229 |
| 5,074,484 | 12/1991 | Kray | 242/129.8 |

FOREIGN PATENT DOCUMENTS

| | | | |
|---|---|---|---|
| 0250464 | 10/1987 | Japan | 355/221 |
| 0100480 | 5/1988 | Japan | 355/221 |
| 0267975 | 11/1988 | Japan | 355/221 |
| 0072177 | 3/1989 | Japan | 355/225 |

*Primary Examiner*—A. T. Grimley
*Assistant Examiner*—William J. Royer
*Attorney, Agent, or Firm*—Sandler, Greenblum & Bernstein

[57] ABSTRACT

Imaging apparatus including a photoreceptor, a charging station operative to charge the photoreceptor including an active length of corona wire operatively juxtaposed with the photoreceptor and a corona wire dispenser containing an undispensed length of corona wire contiguous with the active length and at least as long as the active length. The apparatus also includes an exposure station operative to selectively discharge portions of the photoreceptor to form a latent image thereon and a developer operative to develop the latent image. The corona wire dispenser is operative to dispense an appropriate length of the undispensed corona wire to replace the active length of corona wire. The corona wire dispenser preferably includes a dispensing bobbin around which the undispensed corona wire is wound, a lever-plate on which the dispensing bobbin is rotatably mounted, a friction pin and apparatus operating on the lever-plate for forcing an edge of the dispensing bobbin into contact with the friction pin with a given force whereby the undispensed corona wire is dispensed from the dispensing bobbin when tension in the corona wire is greater than a first threshold tension which is directly proportional to the given force and wherein wire continues to be drawn so long as the tension in the corona wire is greater than a second threshold tension.

31 Claims, 5 Drawing Sheets

CHARGING APPARATUS OPERATIVE TO CHARGE A SURFACE

FIELD OF THE INVENTION

The present invention relates to charging devices using corona wire in general, and more particularly to such charging devices that are used in electrostatographic imaging.

BACKGROUND OF THE INVENTION

Charging devices play an important role in electrostatographic imaging. Prior to each exposure, a photoreceptor is charged to an essentially uniform high potential (around 1000 V) by a charging device. The charge potential can be negative or positive, depending on the type of photoreceptor used. In one widely used technique for charging the photoreceptor surface, a charged-particle depositing corona wire is activated near the surface, raising the potential of the photoreceptor by a prescribed voltage (around 1000 V). Two types of chargers employ the corona wire technique, namely the Corotron and the Scotorton. The Corotron uses the corona wire directly by simply mounting a tensioned corona wire charged to a high voltage close to the photoreceptor, while the Scotorton is a Corotron that also employs an intermediate biased grid which controls the charging level. Many versions of Corotrons and Scorotrons are used in practice; one example being a Double Scorotron, which employs two parallel corona wires in charging the photoreceptor.

All of the above mentioned charging devices employing a corona wire have a common problem of corona wire contamination resulting from oxidation and contaminant accumulation; this causes irregularities in the charging process and causes an inhomogeneous potential on the photoreceptor. Consequently, corona wires or the entire corona structure must, occasionally, be replaced manually or cleaned. Manually replacing the wire has two drawbacks, first, it adds an extra maintenance burden, and second, there is a noticeable decline in image quality over time, after each replacement of wire.

A great variety of patents are concerned with the problems associated with corona wire replacement and corona wire cleaning. The Patents range from automatic wire-cleaning devices to instruments which aid a substantially manual wire replacement.

U.S. Pat. No. 5,023,748 describes a motor-driven corona wire cleaning device. A driving-wire drives a cleaning member along the corona wire and removes foreign particles which have previously accumulated on the wire. While the device is useful in removing some of the contaminant accumulation off the corona wire thus extending its working life span, it still does not obviate the need to frequently replace the corona wire.

U.S. Pat. No. 5,074,484 describes a Corotron rewiring tool, which is not part of the Corotron, for aiding manual replacement of corona wire. The tool consists of a spool of fresh corona wire from which the wire is manually drawn under low tension, and a member which locks the wire at a fixed position during manual wire tensioning in order to prevent the undrawn wire from being tensioned. A technician may use this tool for replacing corona wire, but it is still the technician who actually performs the replacement.

U.S. Pat. No. 5,008,538 describes a corona charging apparatus including properly prelocated and pretensioned corona wire. Whenever necessary, the assembled apparatus is replaced by a simple procedure with a new assembled apparatus.

U.S Pat. No. 4,746,796 describes a means for supplying a corona charger with corona wire of variable length, in accordance with the width of the processing material used by a photocopier. The invention includes a spring-loaded reel in a cassette for dispensing the corona wire, and means for pulling out the end of the wire to a desired working position. This Patent further provides means for cleaning the wire as it moves in and out of the cassette. The used wire is not replaced by the mechanism of this Patent, rather it is reused until the entire cassette is replaced when the wire is exhausted.

SUMMARY OF THE INVENTION

The present invention solves the problem described above, namely, it provides automatic wire replacement which replaces "used" corona wire by new wire. Furthermore, in a preferred embodiment of the present invention, the mechanical tension in the wire is substantially maintained at a desirable, preset, level. The present invention is adaptable to any charging device using corona wire, such as a Corotron or Scorotron. In a preferred embodiment of the invention, the wire is replaced by a continuous automatic replacement mechanism.

A preferred embodiment of the present invention provides an apparatus for replacing contaminated corona wire, for use with charging devices employing a corona wire. To achieve that goal, a preferred embodiment of the present invention provides a Corotron or a Scotorton with a collector for collecting contaminated corona wire on a take-up bobbin, while replacing it with new corona wire that is unwound from a dispenser which preferably includes a dispensing bobbin. The take-up bobbin is preferably driven by a small electric motor. In one preferred embodiment of the present invention, the bobbins are located at two ends of a Corotron or Scorotron assembly, while a single corona wire segment is stretched between them. In another preferred embodiment of the present invention, both bobbins are located at the same end of a double Corotron or Scorotron, and the corona wire partially wraps around a spindle located at the other end of the Corotron or Scorotron; consequently, two parallel working corona wire segments are stretched across the length of the charger. The electric motor is operated whenever the corona wire needs replacement, and stops automatically after the necessary length of wire has been replaced, preferably as measured by a revolution-counting microswitch. Other methods for measuring the wire length and for collecting the used wire may also be used.

To ensure stabilized mechanical tension in the corona wire, a preferred embodiment of the present invention also employs means for stabilizing wire tension. The dispensing bobbin is rotatably mounted on a lever-plate which is pushed, with a first force which exerts a first lever moment on the lever, so that it pivotly forces the dispensing bobbin against a friction pin. If an attempt is made to rotate the bobbin, the pin exerts a static friction moment on the bobbin. The corona wire tension exerts a second lever moment on the lever which tends to pull the dispensing bobbin away from the friction pin. The wire tension also acts on an inner circumferential edge of the dispensing bobbin, exerting a tension moment which counteracts the friction moment. Whenever the corona wire tension exceeds a first threshold level, the static equilibrium of moments is disturbed. The lever tends to pivot releasing the bobbin from the friction pin. When released, the dispensing bobbin rotates and supplies new wire which causes the wire tension to drop. When the wire tension drops below a second threshold level, the dispensing bobbin is forced against the friction pin, and stops rotating. The second threshold is lower than the first threshold because the dynamic friction, which has some effect on the second threshold, is lower than the static friction, which has some effect on the first threshold. However, in accordance with a preferred embodiment of the dispenser of the present invention, the ratio between first and second thresholds is much lower than the ratio between static and dynamic friction.

The motor powered take-up bobbin pulls the corona wire, during wire replacement, with a force which is large enough to raise the wire tension over the above mentioned first threshold. Thus, the dispensing bobbin is forced to constantly release wire during motor operation. Further, in a static situation, movement of the take-up bobbin is also restrained, so that when the motor is shut off, wire does not unwind back from the take-up bobbin.

In one preferred embodiment of the present invention, the spindle is mounted on a slider base, which is suspended by a spring, insuring a minimal tension level in the wire at all times. Due to the slidable base, the charging device may initially be wired, with little effort, by pulling the spindle towards the bobbins while wrapping new stock wire around the spindle.

BRIEF DESCRIPTION OF THE DRAWINGS

The present invention will be more clearly understood with reference to the following non-limiting description of a preferred embodiment of the invention, taken together with the drawings of which.

DETAILED DESCRIPTION OF A PREFERRED EMBODIMENT

Figure 1:
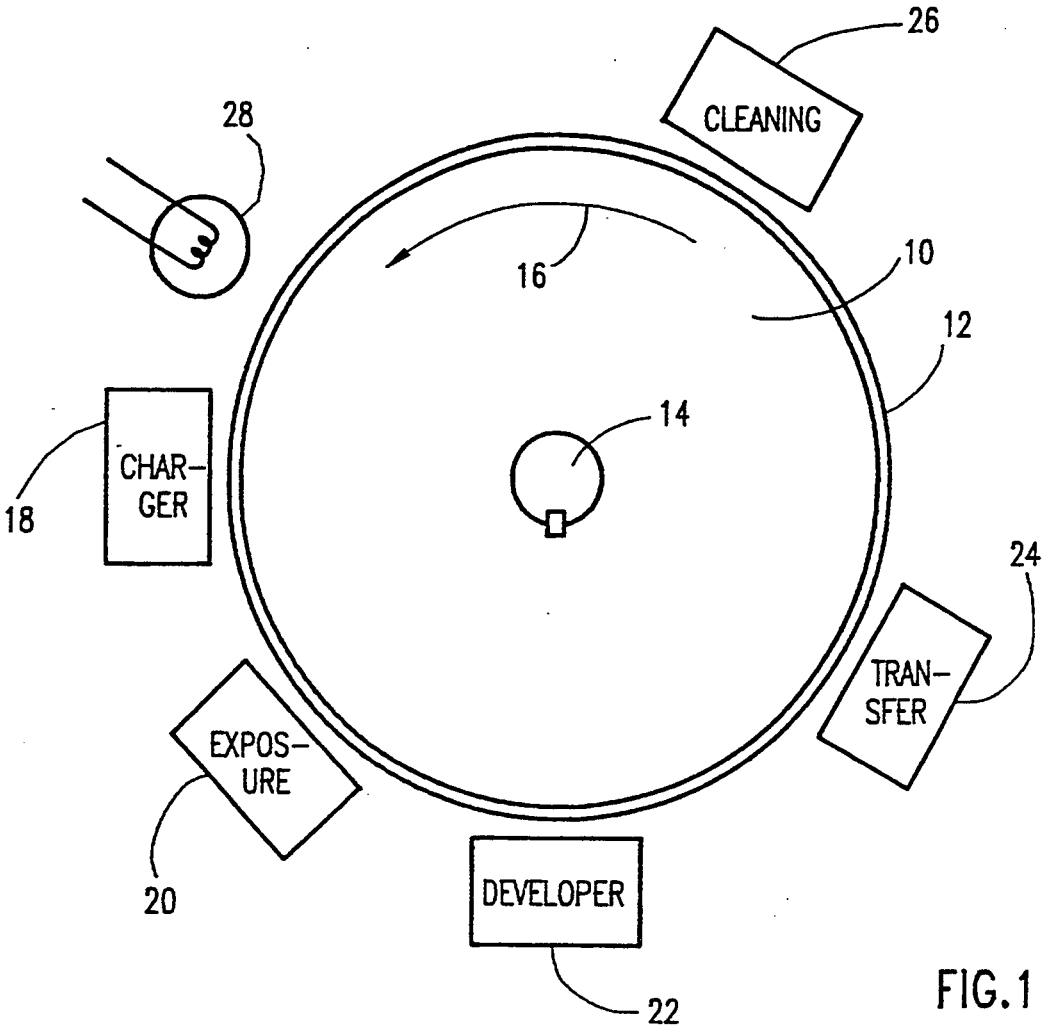
FIG. 1 is a schematic, cross-sectional, drawing of an imaging system in accordance with a preferred embodiment of the invention.

FIG. 1 shows a general plan of an imaging system in accordance with a preferred embodiment of the present invention. A drum 10 is covered with a photoreceptor 12 and is rotated by any suitable means, not shown, about an axle 14 in a direction indicated by arrow 16. Photoreceptor 12 first passes a charger 18, which may be a Corotron or a Scorotron adapted to charge the photoreceptor to a relatively high voltage, typically 1000 volts. Both the Corotron and the Scorotron employ a corona wire to charge photoreceptor 12 by depositing charged particles at its surface. The corona wire is occasionally replaced by a replacement mechanism of the present invention, as more fully described below. Any other charging method which uses corona wire is suitable for use with the present invention. While the present invention is described in accordance with a preferred embodiment of an imaging apparatus, it is equally fit for use with charging devices for charging electrostatic masters or for charging substrates for image transfer thereto.

Photoreceptor 12 next passes an exposure device 20. Any method known in the art for producing a latent electrostatic image on a photoreceptor can be used, including exposure by a scanning laser or by an array of LED devices or to a reflection from a copy sheet. Other methods are also suitable.

The latent image on photoreceptor 12 is developed by a developer 22. Developer 22 can be of any convenient type known in the art, utilizing powder or liquid toners. The developed image produced by developer 22 is transferred to a final substrate at a transfer station 24. Transfer station 24 may be of any suitable type known in the art and may operate by direct transfer to the final substrate or by transfer via an intermediate transfer member. If transfer to the substrate includes charging the substrate with a Corotron or Scorotron, a Corotron or Scorotron according to the invention can be employed.

After transfer of the developed image from the photoreceptor, some of the toner may remain on the photoreceptor. A cleaning station 26, which is next on the route of the photoreceptor, removes the remains of the developed image. Any suitable cleaning station known in the art can be used in the practice of the present invention.

A discharge system 28 completes the cycle. Generally discharge system 28 comprises a lamp or a series of lamps, which illuminate the photoreceptor and remove any charge which remains on the photoreceptor. Other systems for removing charge as are known in the art are also suitable for use in the present invention. Ideally, the photoreceptor, after passing discharge system 28, is completely discharged and is ready for the next imaging cycle.

All of the steps and apparatus thus far described (except for charger 18) are purely conventional and perform the same functions which they perform in conventional systems.

Figure 2A:
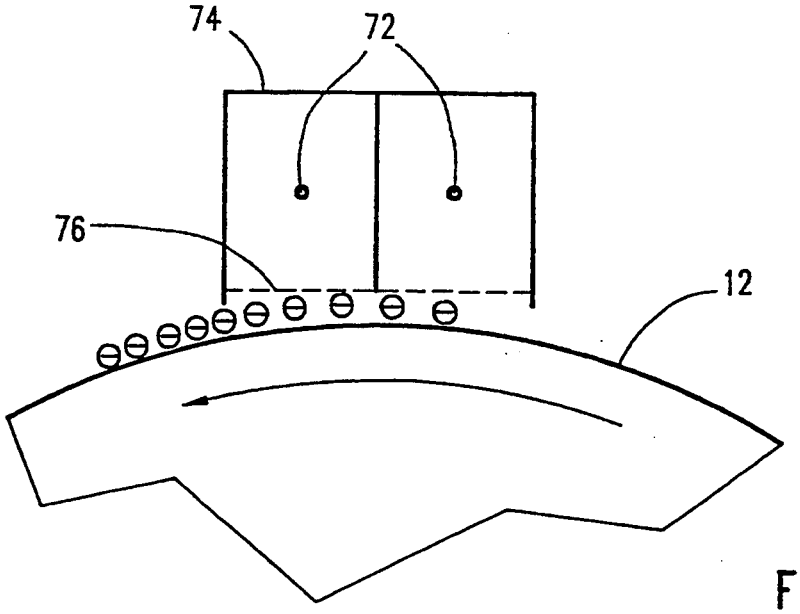
FIG. 2A is a transverse, cross-sectional, schematic of a double Scorotron, with a double housing, charging a photoreceptor.

FIG. 2A shows a cross section schematic of a double Scorotron located in an operative position near photoreceptor 12 of an electrostatographic imaging system, such as a photocopier or a laser printer. In accordance with a preferred embodiment of the present invention, two parallel segments of a corona wire 72 are stretched inside two sections of a double Scotorton housing 74 and generate a charged-particle corona when electrified by a source of high voltage (not shown). The particles move towards photoreceptor 12, passing through a biased grid 76 which controls the charging level, thereby charging the photoreceptor. Due to the double Scotorton embodiment, any given point on photoreceptor 12 is charged by both corona wire segments; this double charging results in a more uniform charge on photoreceptor 12.

Figure 2B:
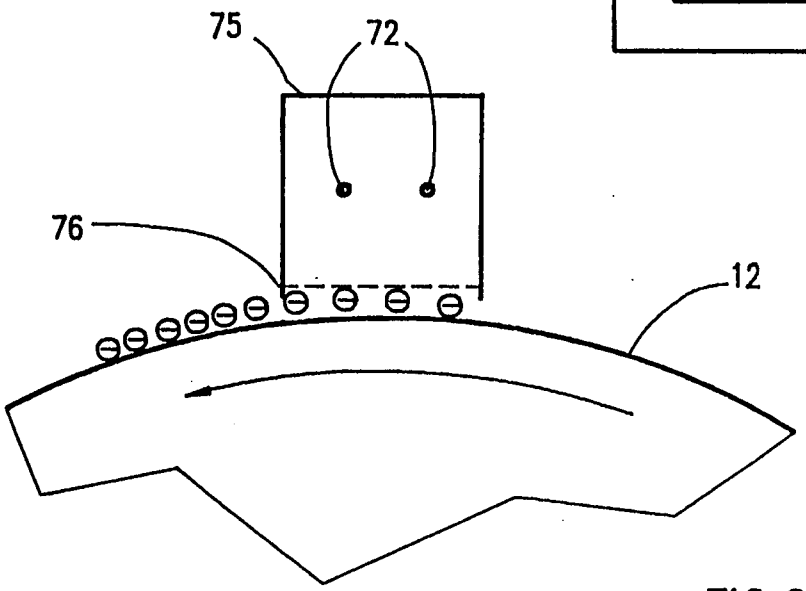
FIG. 2B is a transverse, cross-sectional, schematic of a double Scorotron, with a single housing, charging a photoreceptor.

Another preferred embodiment of the invention, which can be seen in FIG. 2B, employs a single housing 75. The two parallel segments of corona wire, which are closer together in this embodiment than in the embodiment of FIG. 2A, are stretched inside the single section of housing 75.

Figure 3:
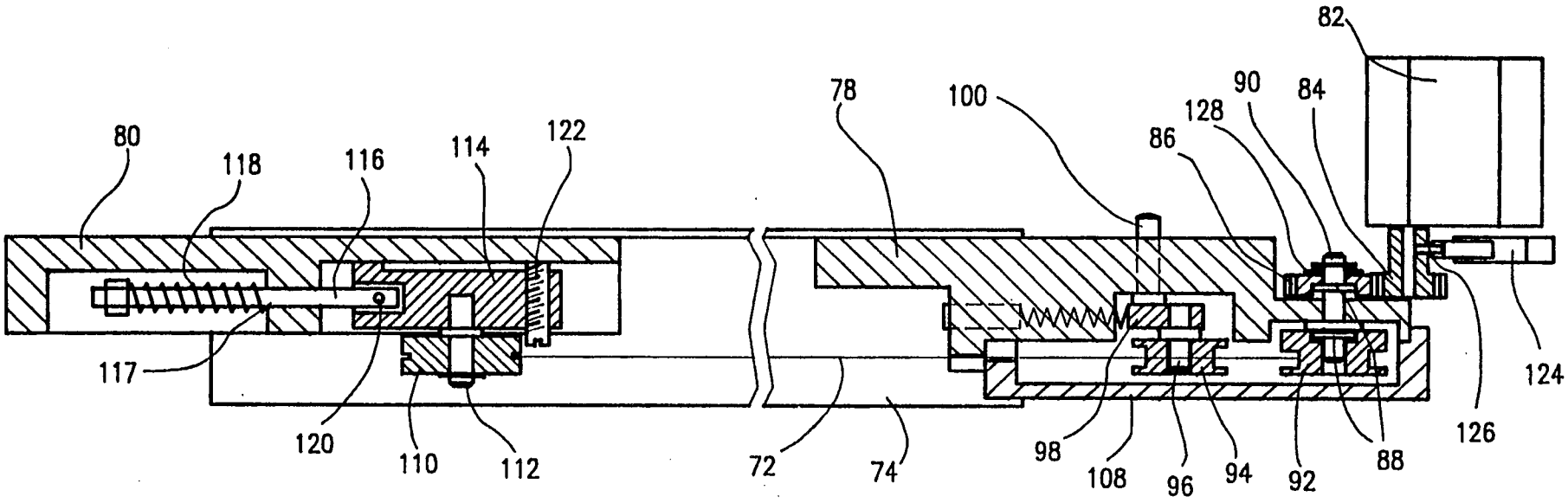
FIG. 3 is a longitudinal, partially sectioned, illustration of a double Scorotron with a double housing, in accordance with a preferred embodiment of the invention.
Figure 4:
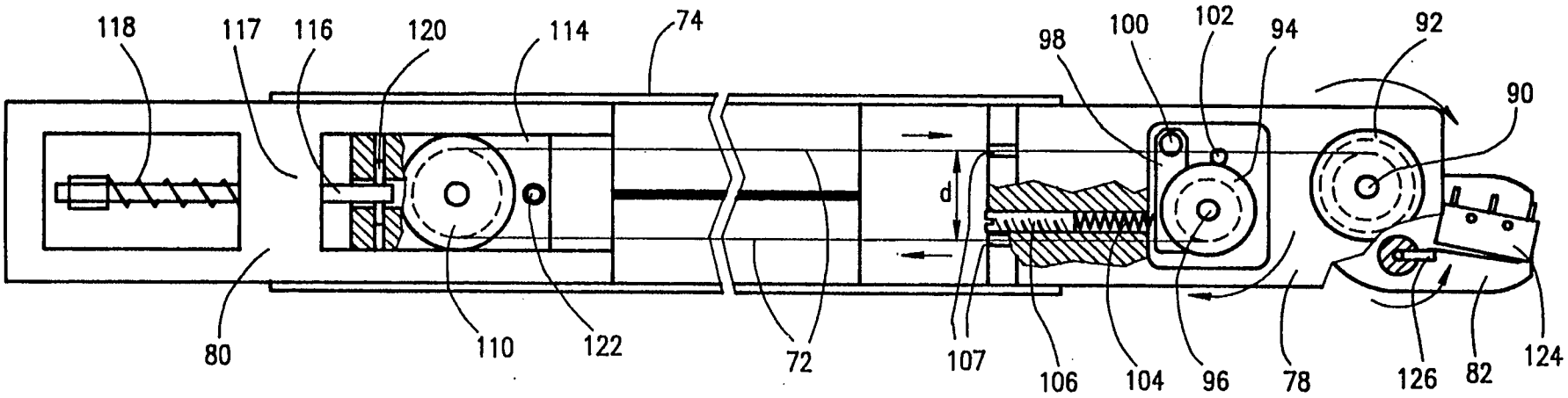
FIG. 4 is a bottom, longitudinal, partially sectioned, illustration of the double Scorotron of FIG. 3.

Reference is now made to FIGS. 3 and 4, which illustrate a corona wire winding and tensioning apparatus built into a double Scotorton arrangement in accordance with a preferred embodiment of the present invention. The winding apparatus comprises a dispensing bobbin 94 for supplying fresh corona wire 72, located at the right end of housing 74; a motor driven take-up bobbin 92 for collecting used or contaminated corona wire 72, also located at the right end of housing 74; and a rotatably mounted spindle 110, around which wire 72 is partially wrapped so that its direction is reversed, situated at the left end of housing 74.

As shown in FIG. 4, bobbins 92 and 94 and spindle 110 are spaced in such a manner that as wire 72 is stretched from bobbin 94 to bobbin 92 around spindle 110, two parallel corona wire segments 72 are formed. The separation "d" between the two parallel segments of wire 72 is set to a suitable working separation, by choosing the appropriate size of roller 110 and appropriately locating bobbins 94 and 92.

Figure 5:
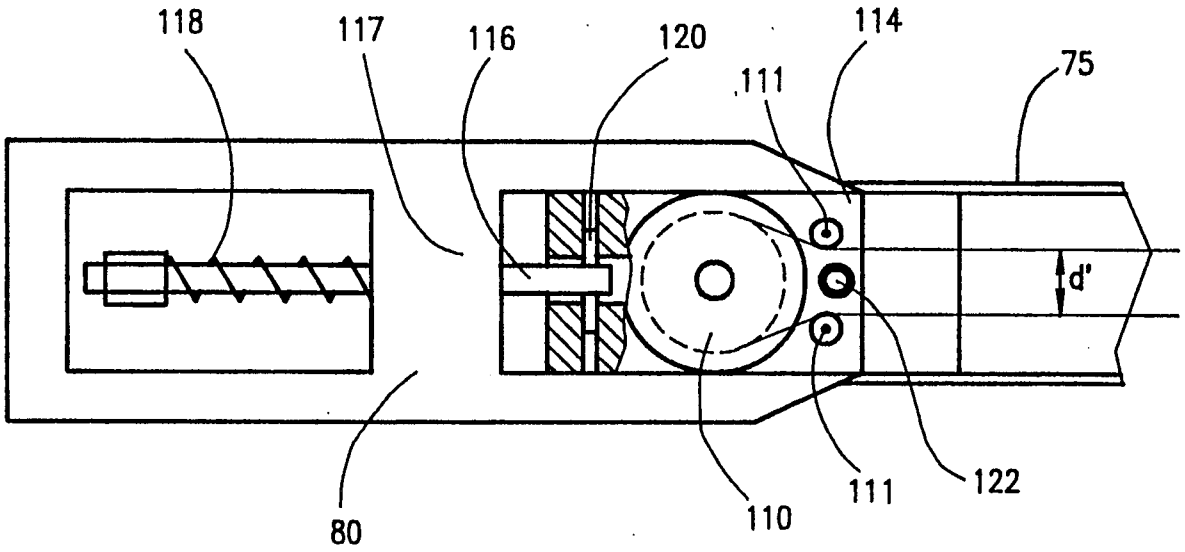
FIG. 5 is a bottom, longitudinal, partially sectioned, illustration of the take-up end of a double Scotorton with a single housing, in accordance with a preferred embodiment of the invention.

As seen in FIG. 5, a similar arrangement of the invention may be used for a double Scotorton with single housing 75, in which the two segments of corona wire 72 are separated by a desired distance "d'" which is shorter than "d". The wire segments are constrained to stretch along paths which are closer together, due to a pair of rotatably mounted constraining spindles 111 which are separated by the desired distance "d'". In order to keep the wire segments parallel as desired, bobbins 92 and 94 must be appropriately located at the right end of housing 75.

As shown in FIG. 3, spindle 110 is covered by a left-cover 80, while bobbins 92 and 94 are protected by mounting plate 78 and a cover 108. Two guide slots 107, separated by distance "d" through which wire 72 flows freely, are formed in mounting plate 78 next to the right end of housing 74. The wire dispensed from bobbin 94 passes through one slot, while the wire returning from roller 110 to bobbin 92 passes through the other slot.

Figure 6:
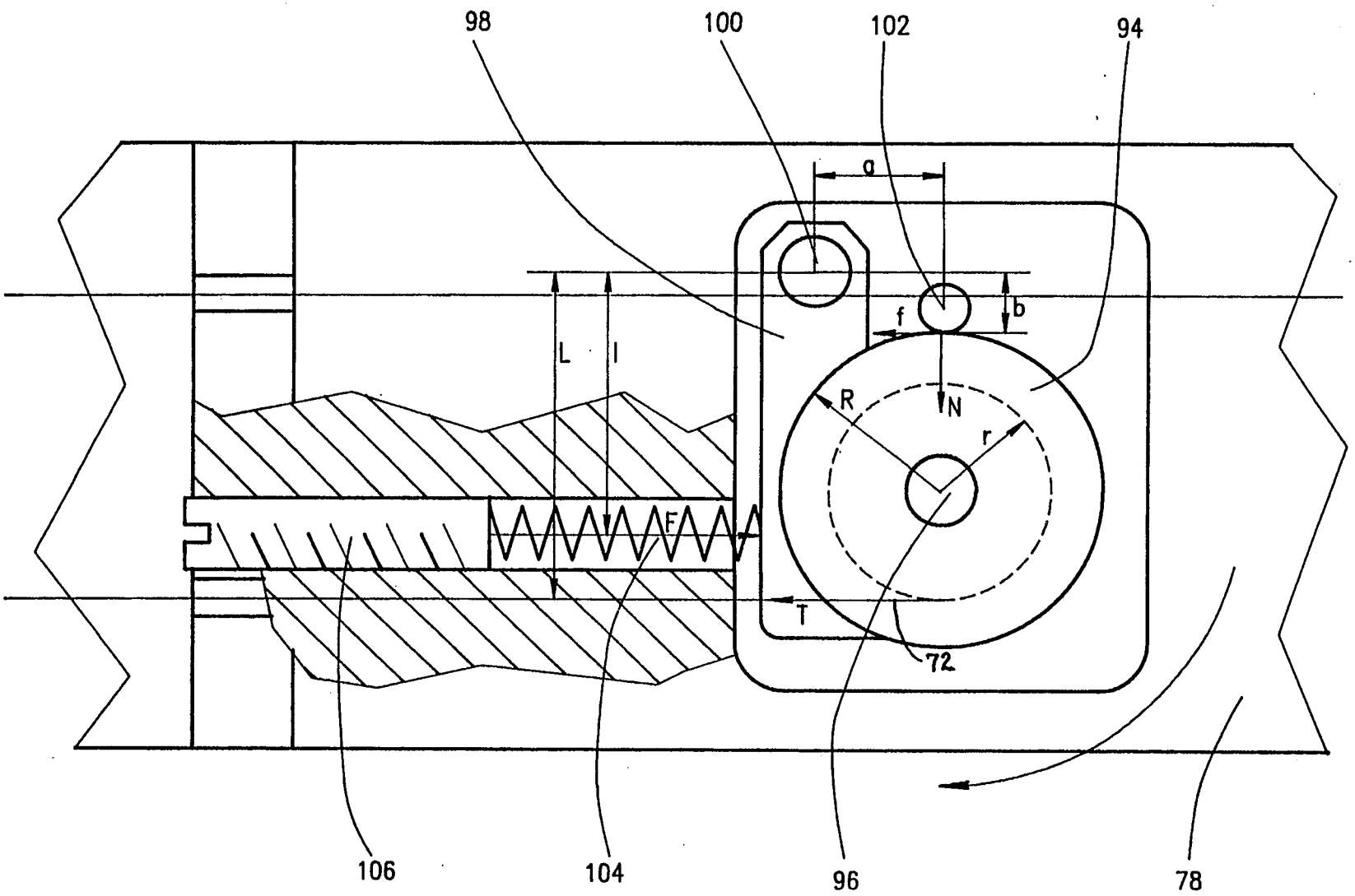
FIG. 6 is a bottom, longitudinal, partially sectioned, blown-up, illustration of-the dispenser assembly of the double Scorotron of FIG. 4.

Reference is now made to FIG. 6, which illustrates the dispenser assembly in more detail. Dispensing bobbin 94 is rotatably mounted on a bobbin shaft 96 which is fixedly mounted on a lever plate 98. Lever 98 is pivotably attached to mounting-plate 78 via an axle 100. In a static situation, wire 72 pulls the inner top edge of bobbin 94 exerting a second tension force "T" on lever 98. A first force "F" is applied to lever 98, preferably by a spring 104 which is preferably situated inside plate 78, which forces the outer edge of bobbin 94 against a friction pin 102. Pin 102, which is fixedly mounted on plate 78, responds with a normal force "N" proportional to the difference between the first force and the second force. Pin 102 also exerts a friction force "f", which acts on bobbin 94 in the rotational direction opposing rotation of the bobbin by tension "T". The moment of friction force "f" is equal to that of tension "T" up to a force which equals "N" times the static friction coefficient, "$\mu_s$". The first force "F" applied by spring 104 is preferably adjustable by a tension adjustment screw 106 to yield a desired level of tension in wire 72. Forces "T" and "F" are related by a substantially constant proportion coefficient, as shown below.

Indicated by "1", "L, "a", and "b" in FIG. 6, are the effective moment-arms of the lines-of-action of respective forces "F", "T", "N", and "f", with respect to axle 100 on which lever 98 pivots, also seen in FIG. 6, are radii "R" and "r" which are the moment-arms of respective forces "f" and "T" with respect to axle 96, on which bobbin 94 rotates.

In a static situation, the sum total of moments acting on bobbin 94 with respect to axle 96 equals zero, therefore:

$$f=T*r/R; \tag{1}$$

since $f \leqq N*\mu_s$, this leads to $$N \geqq T*r/(\mu_s*R); \tag{2}$$

similarly, the sum total of moments acting on lever 98 with respect to axle 100 equals zero, therefore:

$$F*l=T*l+N*a+f*b; \tag{3}$$

substituting equation (1) and inequality (2) into equation (3), i.e. assuming that both bobbin 94 and lever 98 are static, gives:

$$T \leqq F*l*\{L+(r/R)*(b+a*\mu_s^{-1})\}^{-1}. \tag{4}$$

Therefore, tension "T", in a static situation, is constrained to an upper limit which is defined by the right side of inequality (4).

In a preferred embodiment of the invention, the relative values of the different parameters in inequality (4) are carefully chosen. While friction coefficient "$\mu_s$" may fluctuate around a preset value, distances "L", "1", "R", "r", "a", and "b" are all constant. By setting "a" to be relatively small compared to "b" or "L" and, surprisingly, by choosing "$\mu_s$" to be relatively large, the effect of changes in "$\mu_s$" on the right side of inequality (4) may be greatly reduced. Thus, by an appropriate choice of dimensional parameters, the upper limit of tension "T" can be made almost independent of the friction coefficient, and therefore strongly dominated by distances "b" and "L" which are both very stable. In such a preferred embodiment of the invention, equation (4) may be reduced to:

$$T \leqq p*F; \tag{5}$$

where p is substantially a constant.

In a preferred embodiment of the invention, force "F" is adjusted by adjustment screw 106 to maintain the tension "T" at a desired maximum level. For any given value of force "F", a first threshold level of tension "T" is respectively defined by equation (5). This relation is sustained as long as equation (5) holds, i.e. in a static equilibrium. When tension "T" rises above the first threshold level, the static equilibrium is terminated by rotation of bobbin 94 against friction force "f" or, where "$\mu_s$" is extremely large or the dimensions are properly chosen, by pivoting of lever 98.

In accordance with a preferred embodiment of the invention, bobbin 94 starts to rotate whenever tension "T" reaches the first threshold level. In such a dynamic situation, inequality (4) no longer applies. Assuming that bobbin 94 is still in contact with pin 102, the bobbin would remain in motion as long as:

$$T \geqq F*l*\{L+(r/R)*(b+a*\mu_d^{-1})\}^{-1}, \tag{6}$$

wherein "$\mu_d$" is the dynamic friction coefficient between pin 102 and bobbin 94.

As it rotates, bobbin 94 releases new corona wire which gradually decreases tension "T". When wire tension drops below a second threshold tension level, defined by the right side of inequality (6), bobbin 94 stops rotating. Since the dynamic friction coefficient is lower than the static friction coefficient, the second threshold would always be lower than the first threshold. However, since both friction coefficients have little effect on the respective tension thresholds for proper choice of dimensions, in a preferred embodiment of the invention, the difference between the two thresholds can be very slight. Wire tension "T" is always maintained between the first and second threshold levels defined by inequalities (4) and (6).

It is a particular feature of the invention that wire tension "T" is not directly proportional to the friction coefficient between the bobbin 94 and pin 102. It should be evident, by referring to equation (4), that proportion ratio "p" of equation (5) is the sum of three essentially independent terms, whereby only one of the terms is dependent upon static friction coefficient "$\mu_s$" (or "$\mu_d$" for the dynamic case). Thus, by carefully selecting the different parameters of equation (4), it is possible to construct an apparatus which has very little dependence on the friction coefficients. Specifically, if distances "L" and "b", in FIG. 6, are constructed to be relatively large compared to distance "a", the effect of an unstable friction coefficient or of differences between "$\mu_s$" and "$\mu_d$" may be considerably reduced, or even eliminated. It is very important to so reduce the friction dependency, because of the inherent inaccuracies associated with friction coefficients and the inevitable diversity between static and dynamic friction.

As shown in FIGS. 3 and 4 take-up bobbin 92 is axially mounted with a gear 86 on a shaft 90, and both bobbin 92 and gear 86 are connected to shaft 90 by a pair of spring clutches 88. Gear 86 is rotated by wheel 84 which is directly driven by an electric motor 82. Thus, when motor 82 is activated, rotational force is transmitted to take-up bobbin 92, and used corona wire 72 is wound on bobbin 92.

At the left end of housing 74, wire 72 is preferably wrapped around spindle 110, which is, preferably, rotatably mounted to a slider-base 114 by an axle 112. Slider base 114 is pivotably connected to a shaft 116 which firmly holds slider-base 114 against cover 80. A leftward force is applied to shaft 116 by a spring 118 which is mounted on the shaft inside a cavity in the left side of cover 80, while the middle section of shaft 116 can freely move through a constraining tunnel 117. Slider-base 114 is also preferably supplied with a height adjustment screw 122 that controls the separation of the right end of base 114 from cover 80.

As bobbin 92 takes-up wire 72, wire 72 rolls around spindle 110. In order to maintain wire segments 72 parallel to each other at all times, wire 72 flows through guide slots 107 in mounting plate 78, as was noted earlier. In a single housing Scorotron embodiment, which is shown in FIG. 5, the separation between the two wire segments is reduced by the use of constraining spindles 111. In order to position wire segments 72 parallel to photoreceptor 12, slider base 114 is adjusted by height adjustment screw 122, so that spindle 110 and bobbins (92 and 94) lie on a common plane.

Whenever it is necessary to replace corona wire motor 82 is turned on, so that bobbin 92 rotates pulling new corona wire out of bobbin 94. Initially, bobbin 94 is unable to rotate, due to the static friction moment acting upon bobbin 94 by friction pin 102. Thus, as motor 82 begins to rotate, the tension in wire 72 rises until reaching the first threshold tension level, as discussed above. At this point, bobbin 94 starts to rotate, dispensing wire to replace the wire taken up by bobbin 92. The dispensed wire follows a fixed route from bobbin 94 to bobbin 92, guided by guide slots 107 and roller 110.

A preferred embodiment of the invention also provides means for controlling the length of wire 72 which is replaced. Motor 82 is preferably provided with a counting microswitch 124 which is pressed by a protuberant pin 126 connected to wheel 84. For each revolution of motor microswitch 124 is pressed once, and motor 82 turns off after an appropriate number of revolutions have been completed, in accordance with the length of wire that is to be replaced. Other methods for measuring the wire length are also suitable.

As noted above, the dispensing bobbin starts to rotate when corona wire tension exceeds the first threshold, and stops when the tension drops below the second threshold. When motor 82 stops the tension in wire 72 remains at the second threshold level. No more wire is dispensed at this stage, because bobbin 94 does not move in response to forces that are weaker than the first threshold level, which is higher than the second threshold level. But, as noted above, the first tension level may be set to be just slightly higher than the second level, constraining wire 72 to a very narrow range of mechanical tensions. Furthermore, wire 72 is not unwound from bobbin 92, due to a spring washer 128 which is located on shaft 90 next to gear 86. A friction force moment is applied to shaft 90 by spring washer 128, which is sufficient to overcome the tension moment applied to shaft 90 by wire 72.

Similarly, wire tension can never drop below a minimum level, because of the pulling force applied by spring 118 to shaft 116 which holds slider-base 114. The corona wire is wrapped around spindle 110, which is mounted on slider-base 114. During operation, spring 118 can compensate for drops in wire tension by decompressing and moving shaft 116 to the left through constraining tunnel 117. Then shaft 116 pulls base 114 which holds spindle 110 retensioning wire 72. Based on the above, it is clearly understood that wire tension remains essentially constant during operation, possibly having minor fluctuations.

The above description relates to a preferred embodiment of the present invention, in which charger 18 is a double Scorotron. However, it is clear that the same embodiment can be used with a Corotron as charger 18, with a minor variation of removing grid 76. Also, at least two more preferred embodiments of the present invention are possible, in which charger 18 is a single Corotron or a single Scorotron. In such preferred embodiments spindle 110 is not used. Wire 72 passes directly from dispensing bobbin 94 to take-up bobbin 92, wherein the two bobbins are located at opposite ends of housing 74.

It will be appreciated by persons skilled in the art that the present invention is not limited by what has been described hereinabove. Rather the scope of the present invention is defined only by the following claims:

We claim:

1. Imaging apparatus comprising:

a photoreceptor;

a charging station operative to charge the surface of the photoreceptor comprising:

a charging apparatus comprising an active length of corona wire operatively juxtaposed with the surface of the photoreceptor; and a corona wire dispenser containing an undispensed length of corona wire contiguous with the active length wherein the corona wire dispenser comprises:

a dispensing bobbin around which the undispensed corona wire is wound;

a lever-plate on which the dispensing bobbin is rotatable mounted;

a friction pin; and means operating on the lever-plate for forcing an edge of the dispensing bobbin into contact with the friction pin with a given force, whereby the undispensed corona wire is dispensed from the dispensing bobbin when tension in the corona wire is greater than a first threshold tension which is directly proportional to the given force and wherein wire continues so long as the tension in the corona wire is greater than a second threshold tension, and wherein the ratio between the first and second threshold tensions is lower than the ratio between the static and dynamic friction forces acting on the dispensing bobbin by the friction pin;

an exposure station operative to selectively discharge portions of the photoreceptor to form a latent image thereon; and a developer operative to develop the latent image;

2. Apparatus according to claim 2 wherein the undispensed length of corona wire in the corona wire dispenser is at least as long as the active length.

3. Imaging apparatus comprising:

an electrostatic master having an imaging surface having an uncharged latent image formed thereon;

a charging station operative to charge the master comprising:

a charging apparatus comprising an active length of corona wire operatively juxtaposed with the imaging surface; and a corona wire dispenser containing an undispensed length of corona wire contiguous with the active length wherein the corona wire dispenser comprises:

a dispensing bobbin around which the undispensed corona wire is wound;

a lever-plate on which the dispensing bobbin is rotatably mounted;

a friction pin; and means operating on the lever-plate for forcing an edge of the dispensing bobbin into contact with the friction pin with a given force, whereby the undispensed corona wire is dispensed from the dispensing bobbin when tension in the corona wire is greater than a first threshold tension which is directly proportional to the given force and wherein wire continues as long as the tension in the corona wire is greater than a second threshold tension, and wherein the ratio between the first and second threshold tensions is lower than the ratio between the static and dynamic friction forces acting on the dispensing bobbin by the friction pin whereby the uncharged latent image is charged; and a developer operative to develop the charged latent image.

4. Apparatus according to claim 3, wherein the undispensed length of corona wire in the corona wire dispenser is at least as long as the active length.

5. Charging apparatus operative to charge a surface comprising:

an active length of corona wire operatively juxtaposed with a surface to be charged; and a corona wire dispenser containing an undispensed length of corona wire contiguous with the active length and wherein the corona wire dispenser comprises:

a dispensing bobbin around which the undispensed corona wire is wound;

a lever-plate on which the dispensing bobbin is rotatably mounted;

a friction pin; and means operating on the lever-plate for forcing an edge of the dispensing bobbin into contact with the friction pin with a given force;

whereby the undispensed corona wire is dispensed from the dispensing bobbin when tension in the corona wire is greater than a first threshold tension which is directly proportional to the given force and wherein wire continues so long as the tension in the corona wire is greater than a second threshold tension, and wherein the ratio between the first and second threshold tensions is lower than the ratio between the static and dynamic friction forces acting on the dispensing bobbin by the friction pin.

6. Apparatus according to claim 5 wherein the undispensed length of corona wire dispenser is at least as long as the active length.

7. Charging apparatus according to claim 5 wherein the active length of corona wire comprises a single working segment.

8. Apparatus according to claim 7 wherein the undispensed length of corona wire in the corona wire dispenser is at least as long as the active length.

9. Charging apparatus according to claim 5 wherein the active length of corona wire comprises two substantially parallel working segments.

10. Apparatus according to claim 9 wherein the charging apparatus further comprises a reverting spindle operative to divide the active length of corona wire into the two working segments while allowing free movement of the wire from one segment to the other, whereby a short middle section of the active length is partially wrapped around the spindle in shape of a semicircle.

11. Apparatus according to claim 10 wherein the undispensed length of corona wire in the corona wire dispenser is at least as long as the active length.

12. Apparatus according to claim 9 wherein the undispensed length of corona wire in the corona wire dispenser is at least as long as the active length.

13. Apparatus according to claim 5 wherein the means for forcing includes means for adjusting the given force.

14. Apparatus according to claim 13 wherein the means for adjusting comprises a spring and an adjustment screw, wherein the adjustment screw is operative to adjust the force exerted by the spring within a defined range.

15. Apparatus according to claim 13 wherein the undispensed length of corona wire in the corona wire dispenser is at least as long as the active length.

16. Charging apparatus according to claim 5 wherein the charging apparatus includes a grid situated between the active length of corona wire and the photoreceptor.

17. Apparatus according to claim 16 wherein the undispensed length of corona wire in the corona wire dispenser is at least as long as the active length.

18. Charging apparatus according to claim 5 wherein the charging apparatus comprises a high voltage supply operative to electrify the active length of corona wire.

19. Apparatus according to claim 18 wherein the undispensed length of corona wire in the corona wire dispenser is at least as long as the active length.

20. Charging apparatus operative to charge a surface comprising:

an active length of corona wire operatively juxtaposed with a surface to be charged;

a corona wire dispenser containing an undispensed length of corona wire contiguous with the active length operative to dispense an appropriate length of the undispensed corona wire to replace at least a portion of the active length of corona wire; and a used wire collector operative to receive the replaced portion of active length of corona wire comprising: a take-up bobbin;

an electric motor operative to rotate the bobbin; and a revolution-counting-microswitch operative to stop the motor after a given number of revolutions have been completed which corresponds to a desired length of wire wound on the take-up bobbin.

21. Apparatus according to claim 20 wherein the undispensed length of corona wire in the corona wire dispenser is at least as long as the active length.

22. Apparatus according to claim 20 wherein the corona wire dispenser comprises:

a dispensing bobbin around which the undispensed corona wire is wound;

a lever-plate on which the dispensing bobbin is rotatably mounted;

a friction pin; and means operating on the lever-plate for forcing an edge of the dispensing bobbin into contact with the friction pin with a given force;

whereby the undispensed corona wire is dispensed from the dispensing bobbin when tension in the corona wire is greater than a first threshold tension which is directly proportional to the given force and wherein wire continues to be drawn so long as the tension in he corona wire is greater than a second threshold tension, and wherein the ratio between the first and second threshold tensions is lower than the ratio between the static and dynamic friction forces acting on the dispensing bobbin by the friction pin.

23. Apparatus according to claim 22 wherein the undispensed length of corona wire in the corona wire dispenser is at least as long as the active length.

24. Charging apparatus operative to charge a surface comprising:

an active length of corona wire operatively juxtaposed with a surface to be charged;

a corona wire dispenser containing an undispensed length of corona wire contiguous with the active length operative to dispense an appropriate length of the undispensed corona wire to replace at least a portion of the active length of corona wire; and a used wire collector operative to receive the replaced active length of corona wire comprising:

a take-up bobbin mounted on a shaft;

an electric motor operative to rotate the shaft in a given direction; and a spring-washer mounted on the shaft operative to disable the shaft from rotating in a reverse direction, thereby stopping the corona wire from unwinding back from the take-up bobbin.

25. Apparatus according to claim 24 wherein the undispensed length of corona wire in the corona wire dispenser is at least as long as the active length.

26. Apparatus according to claim 24 wherein the corona wire dispenser comprising:

a dispensing bobbin around which the undispensed corona wire is wound;

a lever-plate on which the dispensing bobbin is rotatably mounted;

a friction pin; and means operating on the lever-plate for forcing an edge of the dispensing bobbin into contact with the friction pin with a given force;

whereby the undispensed corona wire is dispensed from the dispensing bobbin when tension in the corona wire is greater than a first threshold tension which is directly proportional to the given force and wherein wire continues to be drawn so long as the tension in the corona wire is greater than a second threshold tension, and wherein the ratio between the first and second threshold tensions is lower than the ratio between the static and dynamic friction forces acting on the dispensing bobbin by the friction pin.

27. Apparatus according to claim 26 wherein the undispensed length of corona wire in the corona wire dispenser is at least as long as the active length.

28. Imaging apparatus comprising:

an electrostatic master having an uncharged latent image formed thereon;

charging apparatus operative to charge the uncharged latent image master comprising:

an active length of wire juxtaposed with the master;

a corona wire dispenser containing an undispensed length of corona wire contiguous with the active length operative to dispense an appropriate length of the undispensed length to replace at least a portion of the active length of corona wire; and a used wire collector operative to receive the replaced portion of active length of corona wire comprising:

a take up bobbin;

an electric motor operative to rotate the bobbin; and a revolution counting microswitch operative to stop the motor after a given number of revolutions have been completed which corresponds to a desired length of wire wound on the take-up bobbin; and a developer operative to develop the charged latent image.

29. Imaging apparatus comprising:

an electrostatic master having an uncharged latent image formed thereon;

charging apparatus operative to charge the uncharged latent image master comprising:

an active length of wire juxtaposed with the master;

a corona wire dispenser containing an undispensed length of corona wire contiguous with the active length operative to dispense an appropriate length of the undispensed length to replace at least a portion of the active length of corona wire; and a used wire collector operative to receive the replaced portion of active length of corona wire comprising:

a take up bobbin mounted on a shaft;

an electric motor operative to rotate the shaft in a given direction; and a spring-washer mounted on the shaft operative to disable the shaft from rotating in a reverse direction, thereby stopping the corona wire from unwinding back from the take-up bobbin; and a developer operative to develop the charged latent image.

30. Imaging apparatus comprising:

a photoreceptor;

charging apparatus operative to charge the photoreceptor comprising:

an active length of wire juxtaposed with the photoreceptor;

a corona wire dispenser containing an undispensed length of corona wire contiguous with the active length operative to dispense an appropriate length of the undispensed length to replace at least a portion of the active length of corona wire; and a used wire collector operative to receive the replaced portion of active length of corona wire comprising:

a take up bobbin;

an electric motor operative to rotate the bobbin; and a revolution counting microswitch operative to stop the motor after a given number of revolutions have been completed which corresponds to a desired length of wire wound on the take-up bobbin;

an exposure station operative to selectively discharge portions of the photoreceptor to form a latent image thereon; and a developer operative to develop the latent image.

31. Imaging apparatus comprising:

a photoreceptor;

charging apparatus operative to charge the photoreceptor comprising:

an active length of wire juxtaposed with the photoreceptor;

a corona wire dispenser containing an undispensed length of corona wire contiguous with the active length operative to dispense an appropriate length of the undispensed length to replace at least a portion of the active length of corona wire; and a used wire collector operative to receive the replaced portion of active length of corona wire comprising:

a take up bobbin mounted on a shaft;

an electric motor operative to rotate the shaft in a given direction; and a spring-washer mounted on the shaft operative to disable the shaft from rotating in a reverse direction, thereby stopping the corona wire from unwinding back from the take-up bobbin;

an exposure station operative to selectively discharge portions of the photoreceptor to form a latent image thereon; and a developer operative to develop the latent image.

* * * * *

UNITED STATES PATENT AND TRADEMARK OFFICE

CERTIFICATE OF CORRECTION

PATENT NO. : 5,337,131
DATED : August 9, 1994
INVENTOR(S) : Oded SAGIV et al.

It is certified that error appears in the above-indentified patent and that said Letters Patent is hereby corrected as shown below:

At column 1, line 23, change "Scotorton" to ---Scorotron---.
At column 1, line 26, change "Scotorton" to ---Scorotron---.
At column 2, line 33, change "Scotorton" to --Scorotron---.
At column 3, line 56, change "Scotorton" to ---Scorotron---.
At column 3, line 66, change "of-the" to ---of the---.
At column 4, line 61, change "Scotorton" to ---Scorotron---.
At column 4, line 67, change "Scotorton" to ---Scorotron---.
At column 5, line 11, change "Scotorton" to ---Scorotron---.
At column 5, line 30, change "Scotorton" to ---Scorotron---.
At column 6, line 22. change "T*I" to ---T*L---.
At column 8, line 1, change "wire" to ---wire 72---.
At column 9, line 34 (claim 2. line 1), change "claim 2" to ---claim 1---.
At column 10, line 35 (claim 6, line 2), change "wire dispenser" to ---wire in the corona wire dispenser---.

Signed and Sealed this

Eighteenth Day of April, 1995

Bruce Lehman

*Attest:*

BRUCE LEHMAN

*Commissioner of Patents and Trademarks*

*Attesting Officer*